United States Patent [19]

Rudick et al.

[11] Patent Number: 4,779,761

[45] Date of Patent: Oct. 25, 1988

[54] BEVERAGE DISPENSER PUMP SYSTEM WITH PRESSURE CONTROL DEVICE

[75] Inventors: Arthur G. Rudick, Marietta; Robert D. Hughes, IV, Atlanta; Jonathan Kirschner; Kenneth G. Smazik, both of Marietta; Gary V. Paisley, Lilburn, all of Ga.

[73] Assignee: The Coca-Cola Company, Atlanta, Ga.

[21] Appl. No.: 24,933

[22] Filed: Mar. 12, 1987

Related U.S. Application Data

[63] Continuation-in-part of Ser. No. 925,426, Oct. 31, 1986, abandoned, and a continuation-in-part of Ser. No. 924,381, Oct. 29, 1986, abandoned.

[51] Int. Cl.[4] ..... B67D 5/56

[52] U.S. Cl. ..... 222/1; 222/129.2; 222/146.1; 417/245

[58] Field of Search ..... 137/565; 251/61.4, 61.5; 417/245, 349; 222/129.1–129.4, 61, 135, 145, 146.1, 146.2, 146.5, 146.6, 255, 263, 334, 372, 373, 386.5, 399, 105, 1

[56] References Cited

U.S. PATENT DOCUMENTS

| | | | |
|---|---|---|---|
| 2,427,429 | 9/1947 | Waite et al. | 222/129.2 X |
| 2,736,466 | 2/1956 | Rodth | 222/129.2 X |
| 3,233,779 | 2/1966 | Cornelius | 222/52 |
| 3,640,277 | 2/1972 | Adelberg . | |
| 3,640,433 | 2/1972 | Rodth | 222/129.2 |
| 3,836,335 | 9/1974 | Eppes | 23/259 |
| 4,008,832 | 2/1977 | Rodth | 222/129.1 |
| 4,098,434 | 7/1978 | Uhlig | 222/94 |
| 4,138,036 | 2/1979 | Bond | 222/105 |
| 4,171,191 | 10/1979 | Krueger | 417/539 |
| 4,273,261 | 6/1981 | Krueger | 222/135 |
| 4,390,035 | 6/1983 | Hill | 137/99 |
| 4,510,969 | 4/1985 | Rodth | 137/614.05 |

FOREIGN PATENT DOCUMENTS

| | | | |
|---|---|---|---|
| 247934 | 1/1948 | Switzerland | 222/386.5 |

*Primary Examiner*—Michael S. Huppert

[57] ABSTRACT

In a post-mix beverage dispenser in which the concentrate is metered (or portioned) by a positive displacement metering pump having check valves, the improvement of a pressure control device for pressurizing the outlet line from the pump to prevent "blow-thru" of pressurized concentrate through the check valves of the pump, whereby the dispenser can be inexpensively used with a pressurized concentrate source. In addition, a post-mix beverage dispensing system including such metering pump and pressure control device and also including a pressurized canister holding pliable 5+1 juice concentrate at a temperature below 32° F., and a heater for heating the concentrate in the concentrate line.

24 Claims, 5 Drawing Sheets

BEVERAGE DISPENSER PUMP SYSTEM WITH PRESSURE CONTROL DEVICE

CROSS-REFERENCE TO RELATED APPLICATION

This is a continuation-in-part of U.S. patent application Ser. No. 925,426, entitled BEVERAGE DISPENSER PUMP SYSTEM WITH PRESSURE CONTROL DEVICE, filed Oct. 31, 1986, by Arthur G. Rudick and Robert D. Hughes, IV, now abandoned, and is also a continuation-in-part of U.S. Pat. application Ser. No. 924,381, entitled Post-mix Juice Dispensing System filed Oct. 29, 1986, by Jonathan Kirschner, Kenneth G. Smazik and Gary V. Paisley, now abandoned.

BACKGROUND OF THE INVENTION

1. Field of the Invention

This invention relates to post-mix beverage dispensers, such as for soft drinks and juices, and in particular to an inexpensive, positive displacement metering pump therefor useful with a pressurized source of concentrate.

2. Description of the Prior Art

Positive displacement, metering (portioning), pumps with check valves are known for use in post-mix beverage dispensers for juice wherein the juice concentrate is not under pressure. One such pump includes a double acting water pump connected to and driving a double acting concentrate pump. The water pressure operates the pump, and the pump chambers have the desired volume ratio of concentrate to water to perform the volumetric ratio control or metering of the two liquids. However, such a pump can not be used with a pressurized source of concentrate, because the check valves will allow "blow-thru," which is concentrate flowing directly through the pump, in effect, bypassing the pump and thus bypassing the volumetric ratio control performed by the pump.

A known way to eliminate flow through the check valves when a pressurized reservoir is employed requires placing a spring loaded poppet valve in the concentrate outlet. Force closing the poppet would have to be set at some value greater than the maximum inlet pressure. If the closing force was less than the maximum inlet pressure and a higher pressure was countered, non-metered flow would occur. The disadvantage of this known scheme is that the poppet would also be required to pressurize the concentrate to a value greater than the closing force of the pump. Operating the pump at higher pressure would greatly decrease the life of the pump components. A primary object of the present invention is to maintain a back pressure that is just slightly greater than the inlet pressure.

Regarding the post-mix beverage dispensing system of the present invention it is known to convert a pressurized juice dispensing system not using a metering pump to one using a positive displacement pump, however, in such known conversion it is necessary to go to the expense, time and trouble of converting the pressurized concentrate source to a vented source so that the concentrate will not be under pressure.

It is an object of the present invention to overcome the above-mentioned problems in the prior art, so that such a positive displacement, metering pump with check valves can also be used with a pressurized source of concentrate, without requiring an unacceptably large, heavy and expensive pump.

It is another object of this invention to provide a post-mix beverage dispenser positive displacement, concentrate metering pump provided with check valves, with means for preventing "blow-thru" of concentrate from a pressurized source.

It is another object of the invention to convert a pressurized juice dispensing system not using a metering pump to one using a positive displacement pump, without the necessity and expense of converting the pressurized concentrate source to a vented source.

It is another object of this invention to prevent "blow-thru" of concentrate in a post-mix beverage dispensing system using a positive displacement metering pump by pressurizing the outlet line with the pressure of the inlet line plus an additional pressure, rather than just pressurizing the outlet line to a set pressure, which would require the pump to have to overcome an unnecessarily high outlet pressure.

It is another object of this invention to provide a post-mix soft drink dispensing system including a pressurized concentrate source and a positive displacement concentrate metering pump using check valves, that includes means for pressurizing the outlet line therefrom to the pressure of the inlet line plus an additional pressure sufficient to prevent the "blow-thru" of pressurized concentrate through the check valves of said pump.

It is a still further object of this invention to provide a post-mix beverage dispenser using a positive displacement, metering pump having check valves and means for pressuring the outlet line therefrom with the pressurized fluid used to pressurize the concentrate.

It is another object of the present invention to provide a post-mix beverage dispenser system including a positive displacement metering pump having check valves and means for pressurizing the outline line therefrom with the pressure of either the inlet line plus an additional pressure, or to the pressure of the pressurized fluid used to pressurize the concentrate, in combination with a pressurized source of concentrate including a pressurizable canister connected to the concentrate line, means for holding and dispensing a quantity of pliable juice concentrate at a temperature below 32° F., means for pressurizing the canister, and means for heating concentrate in the concentrate line between the canister and the pump.

SUMMARY OF THE INVENTION

A post-mix beverage dispensing system using a positive displacement concentrate metering pump with check valves, and a pressure control device associated with the pump so the pump can be used with a pressurized concentrate. The system can be used with any type of beverage, such as juices, soft drinks, coffee, tea, etc.

The pressure control device pressurizes the outlet line to prevent "blow-thru" of the concentrate from the pressurized concentrate source. In one embodiment, the outlet line is pressurized with the pressure in the inlet line, plus an additional pressure. In another embodiment, it is pressurized with the fluid that pressurizes the concentrate. The control device includes a poppet valve in the outlet line with both fluid pressure and a biasing spring urging it closed. The bias spring can be in the concentrate flow or out of it, and it can have a fixed force or it can be adjustable. The fluid pressure can be the concentrate in the concentrate line, or it can be the fluid used to pressurize the concentrate in the concentrate supply container, for example.

The invention also includes a post-mix beverage dispensing system including a positive displacement concentrate metering pump with check valves and a pressure control device so the pump can be used with pressurized concentrate, and also a pressurizable canister connected to the concentrate line and including means for holding and dispensing a quantity of pliable juice concentrate at a temperature below 32° F., means for pressurizing the canister, and means for heating concentrate in the concentrate line between the canister and the pump.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
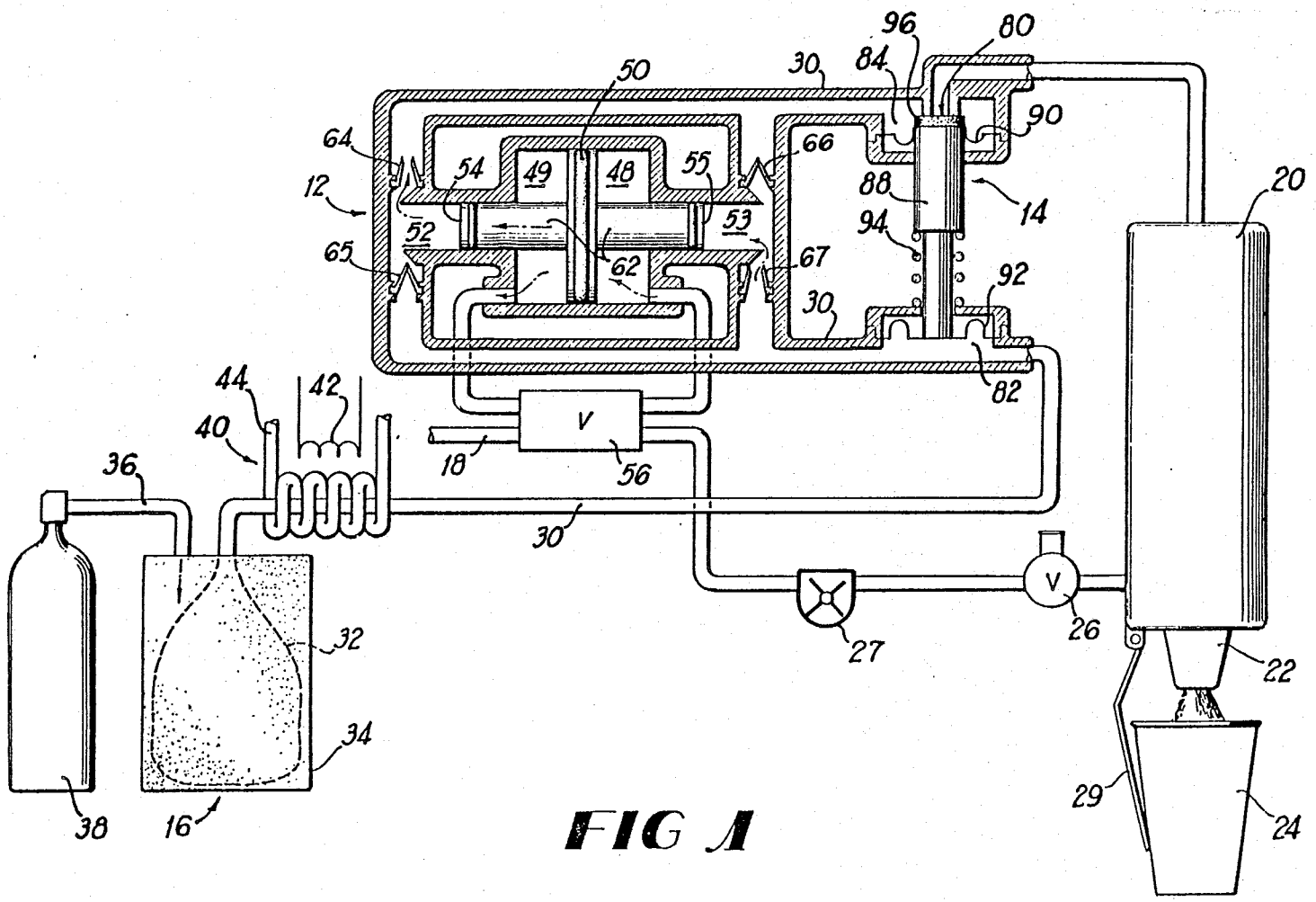
FIG. 1 is a partly schematic, partly diagrammatic view of the preferred embodiment of the beverage dispensing system of the present invention.

With reference now to the drawings, FIG. 1 shows the preferred embodiment of the present invention of a post-mix beverage dispensing system 10 including a positive displacement, metering pump 12 with a pressure control device 14 associated therewith, whereby the pump 12 can be used with a pressurized concentrate source 16, even though it employs simple and inexpensive check valves.

The system 10 includes a water line 18 connected to the pump 12 and then to a mixing chamber 20 having a nozzle 22 for dispensing the final beverage into a cup 24. A solenoid controlled on-off valve 26 is also located in the water line 18, for opening and closing the water line to initiate and terminate dispensing, respectively. A water flow meter 27 can also be included in the water line 18, if it is desired to provide portion control for the system 10. That is, a flow meter can be used with suitable electronics to provide a small, medium and large button to avoid manual filling. A cup-actuated lever arm 29 can also be provided adjacent the nozzle 22, for operating a switch (not shown) to initiate dispensing.

The system 10 also includes a concentrate conduit 30 connected to the pump 12 and then to the mixing chamber 20. A preferred source of concentrate is a flexible bag 32 of pliable 5+1 concentrate at a freezer temperature of about −10° F. to 0° F. At this temperature, 5+1 orange juice concentrate has not undergone a phase change and can flow. The bag 32 is placed in a pressurizable canister 34 pressurized by $CO_2$ or air, for example, from a pressurizing line 36 and a pressure source 38. A heat exchanger 40 is located between the canister 34 and the pump 12 to raise the temperature of the concentrate to preferably about 32° F. to 40° F. The heat exchanger 40 can include a heating element 42 such as an electrical resistance element, and a water line 44 such as a recirculating soda water conduit 44 that may be available in the restaurant.

The pump 12 can be a known type of positive displacement metering pump, such as a double acting pump including a pair of water chambers 48 and 49 and a piston 50, and a pair of concentrate chambers 52 and 53 and pistons 54 and 55. Water pressure causes the water piston 50 to move, the reciprocating action being controlled by a water control valve 56 operated in any known fashion, such as electrically with reed switches, photo-optically, or mechanically using an extension of the connecting rod 62. The water piston 50 is connected to the concentrate pistons 54 and 55 by a connecting rod 62 to also cause the concentrate pistons to reciprocate.

The flow of concentrate through the pump 12 is controlled by four check valves 64, 65, 66 and 67, such as duck billed check valves, and the pressure control device 14.

If the concentrate was not under pressure, the concentrate pump would draw concentrate into one chamber while forcing it out the other, during each reciprocating stroke. However, with a pressurized source, and without the device 14, with the pistons 54 and 55 moving to the left in FIG. 1, for example, the concentrate under pressure would "blow-thru" both chambers 52 and 53. The pressure control device 14 prevents this.

The pressure control device 14 provides a sufficiently higher pressure on the outlet side of the concentrate chambers 52 and 53 than is present on the inlet side, to prevent any such "blow-thru." It is preferred to have the outlet pressure be from about 2–5 psi higher than the inlet pressure. The device 14 includes means for maintaining such a higher pressure in the outlet than in the inlet. The preferred control device includes an inlet chamber 82 in the inlet side, an outet chamber 84 in the outlet side, a poppet valve 80 in the outlet chamber, a reciprocable pressure sensing element 88, a pair of diaphragms 90 and 92 in the chambers 84 and 82, respectively, and a biasing spring 94 urging the element 88 toward its closed position. The spring force determines the $\Delta p$ by which the outlet pressure will exceed the inlet pressure. The diaphragms 90 and 92 provide the seals to prevent leakage out of the conduit 30, and also provide the effective surface area over which the pressure of the liquid is exerted on the element 88. The top portion of the pressure sensing element 88 serves as the valve element and seats against a valve seat 96 when the valve is closed. The poppet valve seats every time the pistons stop or change direction. The valve will maintain an outlet pressure higher than the inlet pressure and terminate flow when required.

By use of the pressure control device 14, the simple and inexpensive pump 12 wih check valves can now also be used in a pressurized system.

The poppet valve in the pressure control device 14 will remain closed and prevent flow of concentrate from the pump until the concentrate outlet pressure exceeds the inlet concentrate pressure. The outlet pressure will exceed the inlet concentrate pressure only when the concentrate pistons in the pump are moving.

Figure 2:
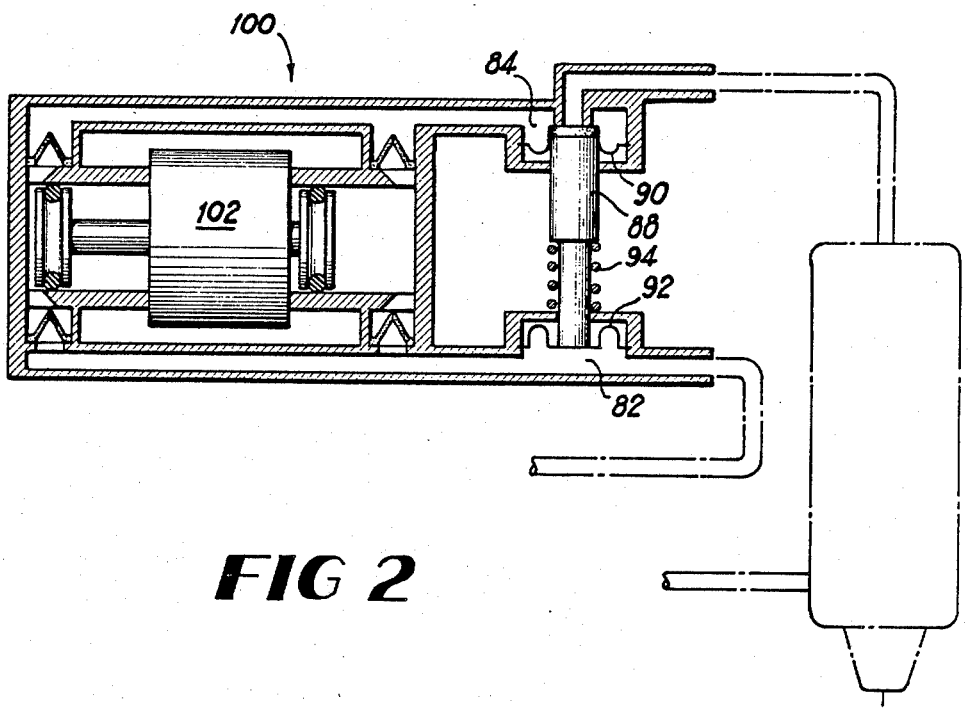
FIGS. 2 and 3 are partly cross-sectional views through a pump and pressure control device according to another embodiment of this invention.
Figure 3:
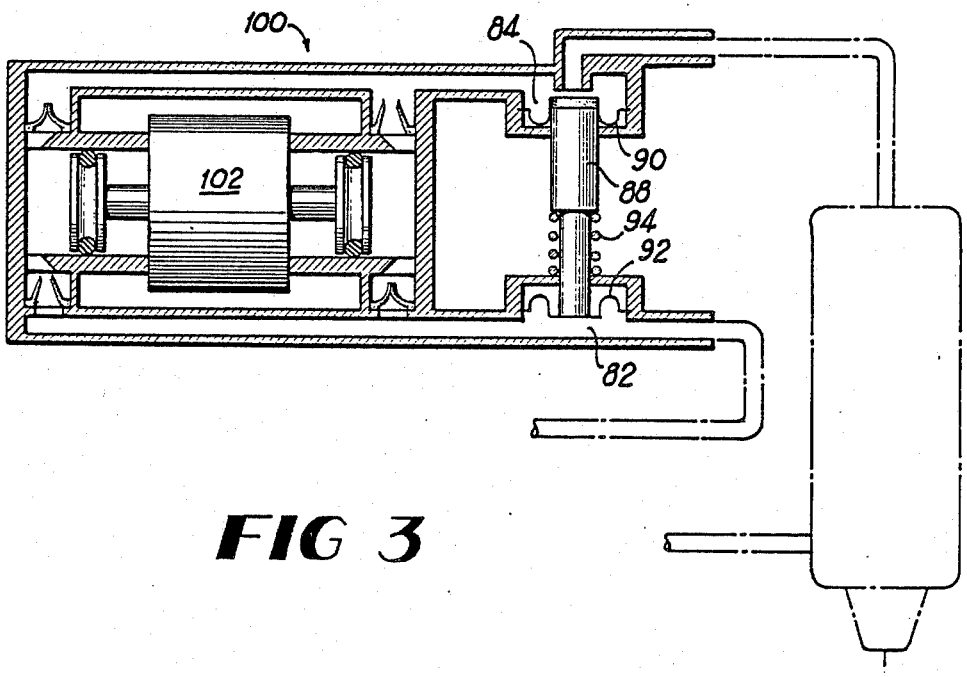

FIGS. 2 and 3 show another embodiment of the present invention, wherein the same pressure control device 14 shown in FIG. 1 is used with a different pump 100.

The pump 100 is a compact linear pump operated by a linear motor 102 having four check valves controlling flow through two chambers. The device 14 prevents "blow-thru" when using a pressurized liquid source. The pump 100 can be used for the concentrate and with some other metering system than that shown in FIG. 1 to control the volumetric ratio of the concentrate and water.

Figure 4:
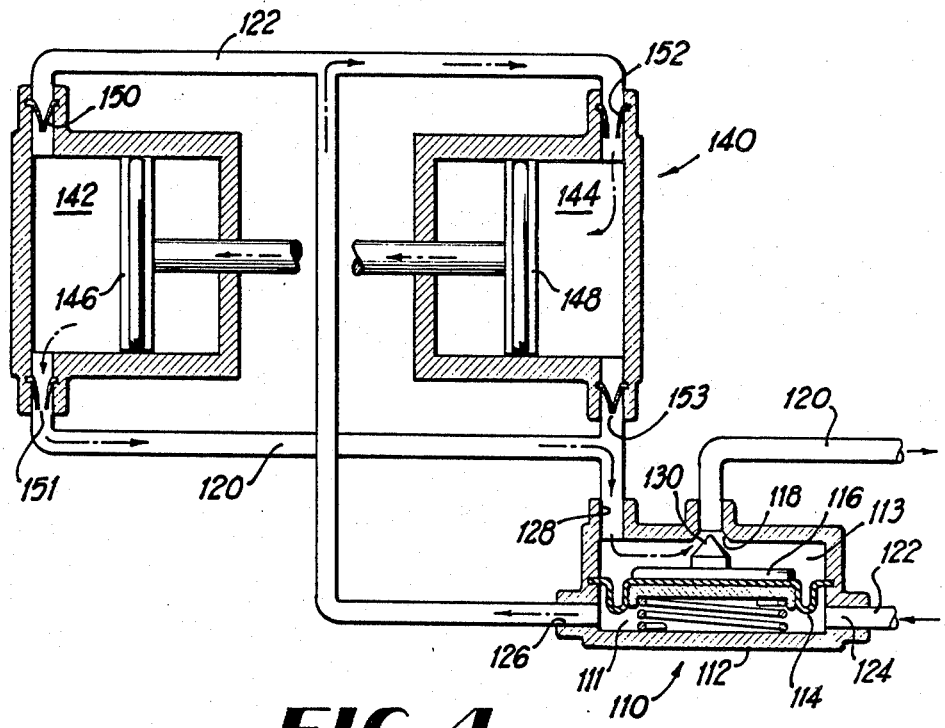
FIG. 4 is a partly diagrammatic, partly schematic view of another embodiment of this invention.

FIG. 4 shows another embodiment of the present invention of a different pressure control device 110. The device 110 includes a single housing 112 separated by a diaphragm 114 into inlet and outlet chambers 111 and 113, respectively. The diaphragm is connected to a rigid valve element 116 that seats on a valve seat 118 in the outlet line 120. The inlet line 122 includes an inlet and an outlet port 124 and 126, respectively, in the inlet chamber 111, and the outlet line 120 includes inlet and outlet ports 128 and 130 in the outlet chamber 113.

The device 110 prevents "blow-thru" of concentrate through the pump 140, having two chambers 142 and 144, two connected pistons 146 and 148, and four check valves 150, 151, 152 and 153.

Figure 5:
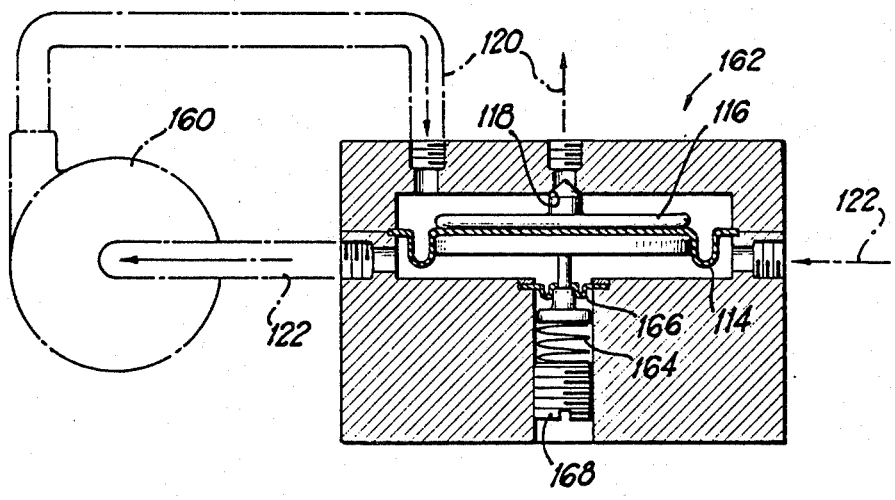
FIG. 5 is a partly cross-sectional view of a still further embodiment of this invention.

FIG. 5 shows another embodiment of the present invention of a positive displacmenet, metering pump 160 (shown schematically, but having check valves to control the flow therethrough), and a pressure control device 162. The device 162 is similar to that shown in FIG. 4 above, except that in FIG. 5 the device 162 uses a spring 164 that is out of the flow path of the liquid, separated by a diaphragm 166, and the spring 164 is adjustable by a screw 168 so that the $\Delta p$ can be varied as desired.

Figure 6:
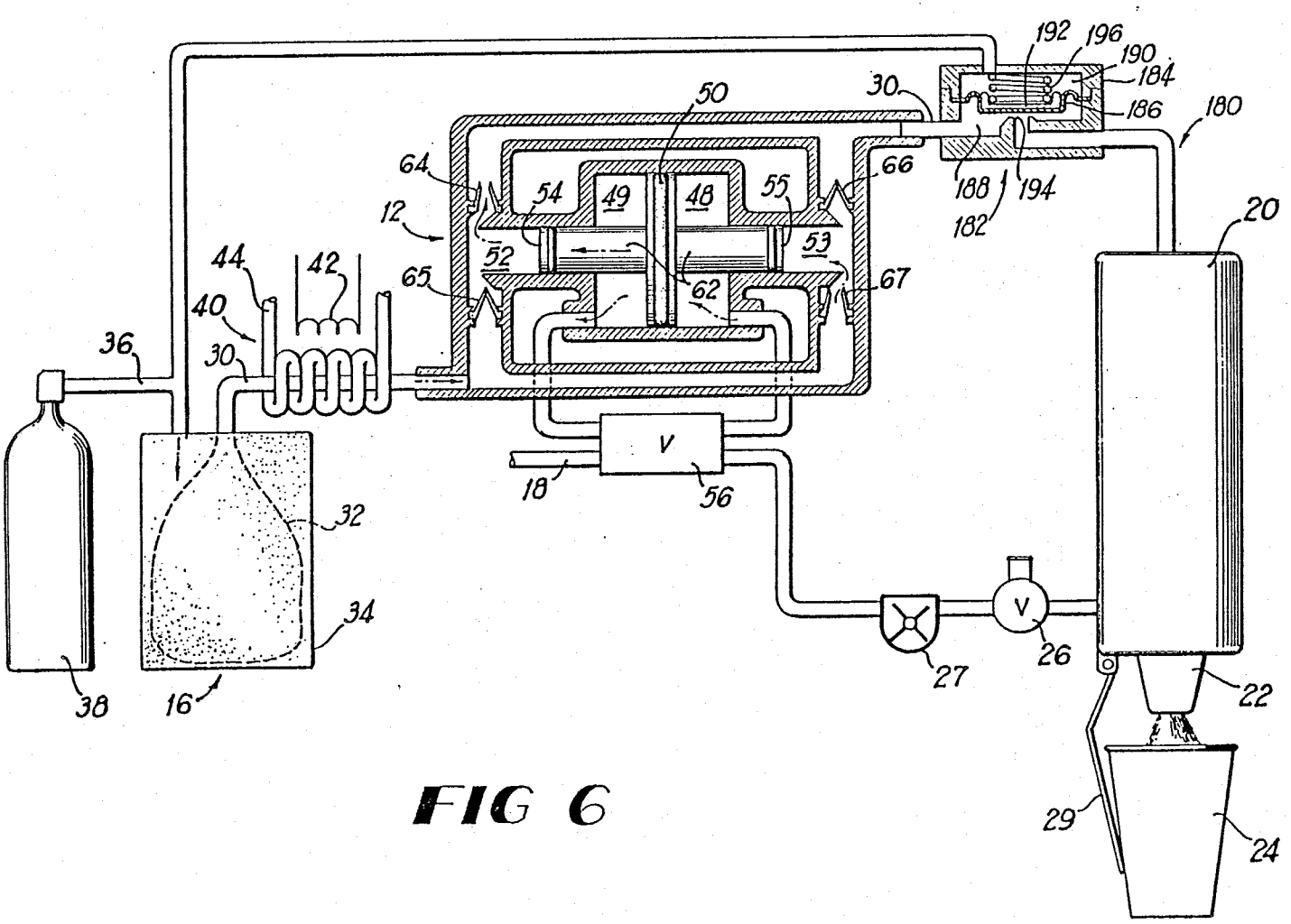
FIG. 6 is a partly cross-sectional, partly diagrammatic view of another embodiment of the present invention.

FIG. 6 shows another embodiment of the present invention of a dispensing system 180 that is identical to the system 10 of FIG. 1 except that system 180 uses a different pressure control device 182 from device 14 of FIG. 1. The control device 182 is connected to the concentrate conduit 30 downstream from the pump 12. The device 182 includes a housing 184 divided by a diaphragm 186 into a concentrate chamber 188 and a pressure chamber 190. The diaphragm 186 is connected to a rigid valve element 192 that seats on a valve seat 194. A biasing spring 196 is located in the pressure chamber 190 to exert a biasing pressure on the valve element 192 urging it to its closed position. The device 182 prevents "blow-thru" of concentrate through the pump 12.

Figure 7:
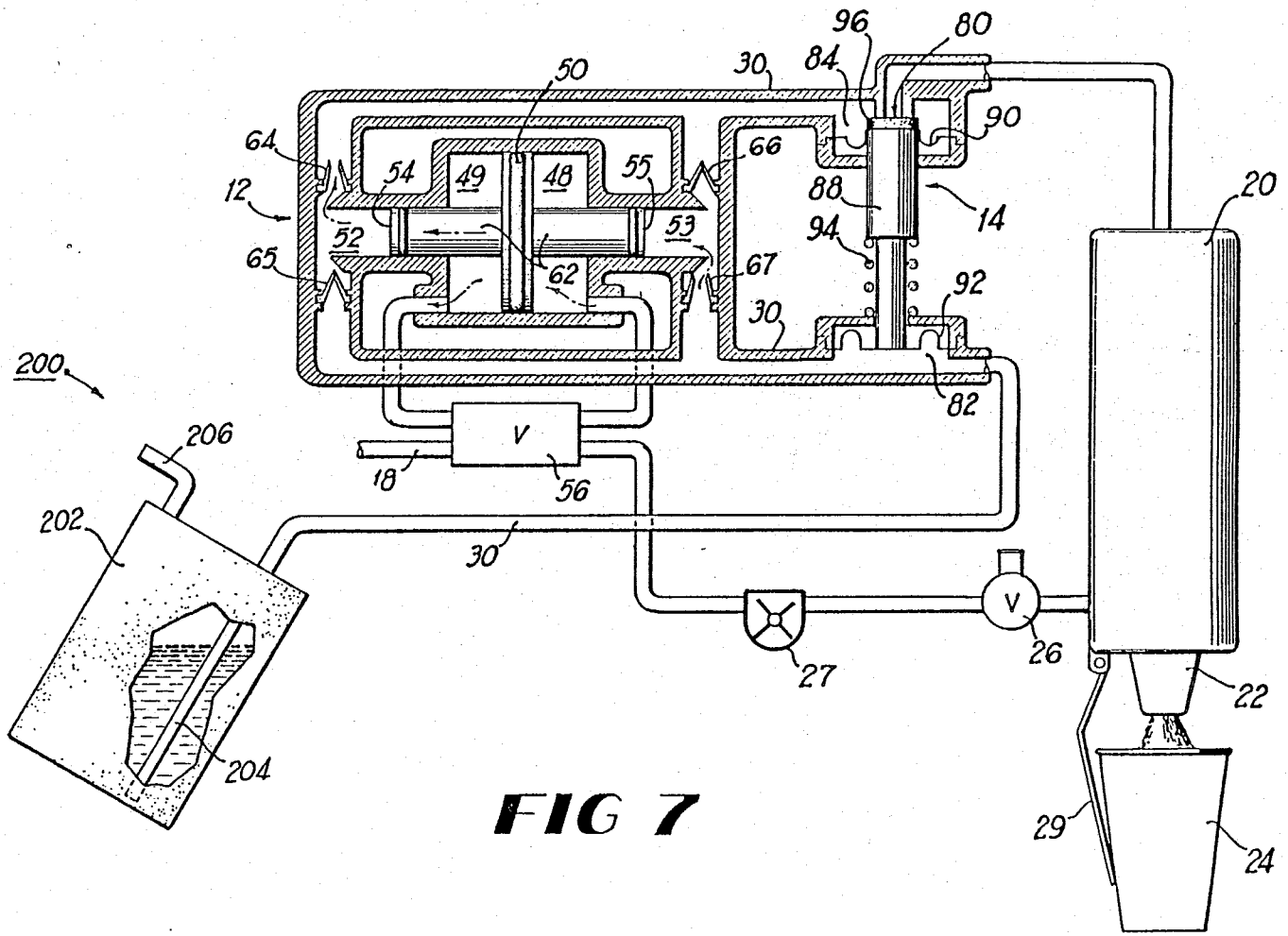
FIG. 7 is a partly cross-sectional, partly diagrammatic view of another embodiment of the present invention.

FIG. 7 shows another embodiment of the present invention of a dispensing system 200 that is similar to the dispensing system shown in FIG. 6 with the exception that the system 200 includes a concentrate reservoir 202 that does not include a separate bag to contain the concentrate but that includes a dip tube 204. The reservoir 202 is pressurized by a gas such as air from a pressurized air source (not shown) via an air line 206. The system 200 is preferably used for concentrate that is above 32° F., in which case there is no need for a heat exchanger.

An advantage and object of this invention includes the conversion of present juice dispensing systems using a pressurized concentrate source that feeds directly to a dispensing valve without a metering pump, to a system using a metering pump. It is known to do this, however, in the known conversion, the pressurized concentrate source must be converted to a vented, non-pressurized source to prevent "blow-thru" of the pressurized concentrate through the check valves of the known positive displacement metering pump. The present invention avoids the time and expense for such conversion to a vented concentrate source, because the pressure control device of this invention prevents "blow-thru" of concentrate through the pump.

While it is known to have the outlet line of the pump pressurized to a set pressure without regard to the inlet line pressure, this would require the pump to be too large, heavy and expensive to have to overcome an unnecesarily high outlet pressure (i.e., the maximum pressure that the inlet pressure might ever reach plus an additional pressure). By relating (or keying) the outlet pressure to the inlet pressure plus an additional pressure, the outlet pressure that must be overcome by the pump is minimized.

This invention is clearly useful as a post-mix soft drink dispensing system using a pressurized concentrate source and a positive displacement concentrate metering pump using check valves, and means for pressurizing the outlet line from the pump to prevent "blow thru" of concentrate therefrom. It is believed that a positive displacement pump was not previously used in a pressurized post-mix soft drink dispensing system because the only known way to prevent "blow-thru" of the pressurized concentrate through the pump was to either use positively controlled flow valves in the pump which would have been prohibitively expensive and complicated, or to use a poppet valve in the outlet line to increase the outlet pressure to avoid "blow-thru", the poppet valve being set to such a high value that the pump wold have to be so large and expensive to overcome such pressure that it was not commercially feasible.

It will be apparent that various alterations, modifications, and changes can be made in the preferred embodiment described herein without departing from the spirit and scope of the present invention as defined in the appended claims. For example, while the preferred embodiment and a few other embodiments have been described, the present invention is not limited to these. Other pressure control devices can be used. For example, while all the connections to the pressure control device from the inlet line are shown as mechanical, this is not essential. There can alternatively be a sensor in the inlet line, electrically connected to a pressurizing device in the outlet line. Also, this invention includes the use of a positive displacement, metering pump with check valves in a post-mix beverage dispenser with a pressure source regardless of the type of beverage, for example, whether it is juice, orange juice, soft drinks, coffee, tea, etc.

What is claimed is:

1. A method for dispensing a post-mix beverage comprising:

(a) providing a positive displacement, concentrate metering pump having check valves for controlling the flow of concentrate therethrough from an inlet line connected to said pump to an outlet line connected to said pump;

(b) connecting said inlet line to a source of pressurized concentrate to be used in dispensing a beverage; and (c) pressurizing said outlet line of said pump to the pressure of said inlet line plus an additional pressure, to prevent said pressurized concentrate from blowing through said check valves, said pressurizing step comprising placing a valve in said outlet line, applying inlet line pressure to said valve in a direction urging it closed, applying outlet line pressure to said valve in a direction urging it open, and applying an additional biasing force against said valve in a direction urging said valve closed.

2. The method as recited in claim 1 including adjusting said additional pressure as desired.

3. A method for dispensing a post-mix beverage comprising:

(a) providing a positive displacement, concentrate metering pump having check valves for controlling the flow of concentrate therethrough from an inlet line connected to said pump to an outlet line connected to said pump;

(b) connecting said inlet line to a source of pressurized concentrate to be used in dispensing a beverage;

(c) pressurizing said outlet line of said pump to the pressure of said inlet line plus an additional pressure, to prevent said pressurized concentrate from blowing through said check valves; and (d) said pressurizing step comprising placing a poppet valve in said outlet line, applying inlet line pressure to said valve in a direction urging it closed, applying outlet line pressure to said valve in a direction urging it open, and applying a biasing spring force against said valve in a direction urging said valve closed.

4. The method as recited in claim 1 wherein said pump is the concentrate side of a volumetric ratio control pump used in a post-mix beverage dispenser, said pump also having a water side operated by water pressure.

5. The method as recited in claim 1 wherein said dispenser is a juice dispenser, and said concentrate is juice concentrate.

6. The method as recited in claim 1 wherein said connecting step comprises connecting said inlet line to a pressurized canister containing a quantity of pliable juice concentrate at a temperature below 32° F., and including the step of heating the concentrate in said inlet line downstream from said canister and upstream from said pump.

7. A post-mix beverage dispenser apparatus comprising:

(a) a water line connected to a mixing chamber having a dispensing nozzle;

(b) a concentrate line connected to said mixing chamber;

(c) a positive displacement, concentrate metering pump in said concentrate line and having an inlet concentrate line to said pump and an outlet concentrate line from said pump, and said pump having check valves to control the flow of concentrate therethrough; and (d) means for pressurizing the outlet line from said pump with the pressure of the inlet line to said pump plus an additional pressure, said pressurizing means including a valve in said outlet line, means for applying inlet line pressure to said valve urging it closed, means for applying outlet line pressure to said valve urging it open, and means for applying an additional biasing force against said valve urging it closed.

8. The apparatus as recited in claim 7 including means for adjusting said additional pressure.

9. A post-mix beverage dispenser apparatus comprising:

(a) a water line connected to a mixing chamber having a dispensing nozzle;

(b) a concentrate line connected to said mixing chamber;

(c) a positive displacement, concentrate metering pump in said concentrate line and having an inlet concentrate line to said pump and an outlet concentrate line from said pump, and said pump having check valves to control the flow of concentrate therethrough;

(d) means for pressurizing the outlet line from said pump with the pressure of the inlet line to said pump plus an additional pressure; and (e) said pressurizing means including a poppet valve in said outlet line, means for applying inlet line pressure to said poppet valve urging it closed, means for applying outlet line pressure to said poppet valve urging it open, and means for applying a biasing spring force against said poppet valve urging it closed.

10. The apparatus as recited in claim 7 including a pressurizable canister connected to said concentrate line and including means for holding and dispensing a quantity of pliable juice concentrate at a temperature below 32° F., means for pressurizing said canister, and means for heating concentrate in said concentrate line between said canister and said pump.

11. A method for converting a post-mix juice dispensing system that feeds concentrate from a pressurized concentrate source to a mixing chamber without using a metering pump, to a system using a metering pump, without converting the pressurized concentrate source to a vented source comprising:

(a) connecting said concentrate source as the inlet to a positive displacement metering pump having check valves;

(b) connecting an outlet line from said metering pump to a mixing chamber; and (c) pressurizing said outlet line to the pressure of the inlet line plus an additional pressure sufficient to prevent "blow-thru" of pressurized concentrate through said check valves of said pump, said pressurizing step comprising placing a valve in said outlet line, applying inlet line pressure to said valve in a direction urging it closed, applying outlet line pressure to said valve in a direction urging it open, and applying an additional biasing force against said valve in a direction urging said valve closed.

12. The method as recited in claim 11 including the step of adjusting said additional pressure.

13. A post-mix soft drink dispensing system comprising:

(a) a source of pressurized concentrate;

(b) a positive displacement concentrate metering pump including check valves for controlling the flow therethrough;

(c) a mixing chamber;

(d) an inlet line from said source to an inlet of said pump;

(e) an outlet line from an outlet of said pump to said mixing chamber; and (f) a pressure control device associated with said pump for pressurizing said oulet line of said pump with the pressure of said inlet line plus an additional pressure, said device including a valve in said outlet line, means for applying inlet line pressure to said valve urging it closed, means for applying outlet line pressure to said valve urging it open, and means for applying an additional biasing force against said valve urging it closed.

14. The apparatus as recited in claim 13 including means for adjusting said additional pressure.

15. The apparatus as recited in claim 13 wherein said source of the pressurized concentrate includes a pressurizable canister connected to said inlet line and including means for holding and dispensing a quantity of pliable juice concentrate at a temperature below 32° F., means for pressurizing said canister, and means for heating said concentrate in said inlet line between said canister and said pump.

16. A method for dispensing a post-mix beverage comprising:

(a) providing a positive displacement, concentrate metering pump having check valves for controlling the flow of concentrate therethrough from an inlet line connected to said pump to an outlet line connected to said pump;

(b) connecting said inlet line to a source of pressurized concentrate to be used in dispensing a beverage, said concentrate being in a rigid container under the pressure of a pressurizing gas; and (c) pressurizing said outlet line of said pump to the pressure of said pressurizing gas plus an additional pressure, to prevent said pressurized concentrate from blowing through said check valves, said pressurizing step comprising placing a valve in said outlet line, applying said pressurized gas to said valve in a direction urging it closed, applying outlet line pressure to said valve in a direction urging it open, and applying an additional biasing force against said valve in a direction urging said valve closed.

17. A method for dispensing a post-mix beverage comprising:

(a) providing a positive displacement, concentrate metering pump having check valves for controlling the flow of concentrate therethrough from an inlet line connected to said pump to an outlet line connected to said pump;

(b) connecting said inlet line to a source of pressurized concentrate to be used in dispensing a beverage, said concentrate being in a rigid container under the pressure of a pressurizing gas;

(c) pressurizing said outlet line of said pump to the pressure of said pressurizing gas plus an additional pressure, to prevent said pressurized concentrate from blowing through said check valves; and (d) said pressurizing step comprising placing a poppet valve in said outlet line, applying said pressurized gas to said valve in a direction urging it closed, applying outlet line pressure to said valve in a direction urging it open, and applying a biasing spring force against said valve in a direction urging said valve closed.

18. The method as recited in claim 16 wherein said pump is the concentrate side of a volumetric ratio control pump used in a post-mix beverage dispenser, said pump also having a water side operated by water pressure.

19. The method as recited in claim 16 wherein said connecting said inlet line to a canister containing a quantity of pliable 5+1 juice concentrate at a temperature below 32° F. and including the step of heating the concentrate in said inlet line downstream from said canister and upstream from said pump.

20. A post-mix beverage dispenser apparatus comprising:

(a) a water line connected to a mixing chamber having a dispensing nozzle;

(b) a concentrate bag in a rigid container under pressure of a pressurizing gas;

(c) a concentrate line connecting said bag to said mixing chamber;

(d) a positive displacement, concentrate metering pump in said concentrate line and having an inlet concentrate line from said bag to said pump and an outlet concentrate line from said pump to said mixing chamber, and said pump having check valves to control the flow of concentrate therethrough; and (e) means for pressurizing the outlet line from said pump with the pressure of said pressurizing gas plus an additional pressure, said pressurizing means including a valve in said outlet line, means for applying said pressurizing gas to said valve urging it closed, means for applyng outlet line pressure to said valve urging it open, and means for applying an an additional biasing force against said valve urging it closed.

21. A post-mix beverage dispenser apparatus comprising:

(a) a water line connected to a mixing chamber having a dispensing nozzle;

(b) a concentrate bag in a rigid container under pressure of a pressurizing gas;

(c) a concentrate line connecting said bag to said mixing chamber;

(d) a positive displacement, concentrate metering pump in said concentrate line and having an inlet concentrate line from said bag to said pump and an outlet concentrate line from said pump to said mixing chamber, and said pump having check valves to control the flow of concentrate therethrough;

(e) means for pressurizing the outlet line from said pump with the pressure of said pressurizing gas plus an additional pressure; and (f) said pressurizing means including a poppet valve in said outlet line, means for applying said pressurizing gas to said poppet valve urging it closed, means for applying outlet line pressure to said poppet valve urging it open, and means for applying a biasing spring force against said poppet valve urging it closed.

22. The apparatus as recited in claim 20 including a pressurizable canister connected to said concentrate line and including means for holding and dispensing a quantity of pliable juice concentrate at a temperature below 32° F., means for pressurizing said canister, and means for heating concentrate in said concentrate line between said canister and said pump.

23. A method for converting a post-mix juice dispensing system that feeds concentrate from a pressurized concentrate source to a mixing chamber without using a metering pump, to a system using a metering pump, without converting the pressurized concentrate source to a vented source comprising:

(a) connecting said concentrate source as the inlet to a positive displacement metering pump having check valves;

(b) connecting an outlet line from said metering pump to a mixing chamber; and (c) pressurizing said outlet line to the pressure of the pressurized concentrate source plus an additional pressure sufficient to prevent "blow-thru" of pressurized concentrate through said check valves of said pump, said pressurizing step comprising placing a valve in said outlet line, applying said pressurized concentrate pressure to said valve in a direction urging it closed, applying outlet line pressure to said valve in a direction urging it open, and applying an additional biasing force against said valve in a direction urging said valve closed.

24. A post-mix soft drink dispensing system comprising:

(a) a source of pressurized concentrate;

(b) a positive displacment concentrate metering pump including check valves for controlling the flow therethrough;

(c) a mixing chamber;

(d) an inlet line from said source to an inlet of said pump;

(e) an outline line from an outlet of said pump to said mixing chamber; and (f) a pressure control device associated with said pump for pressurizing said outlet line of said pump with the pressure of said source of pressurized concentrate plus an additional pressure, said device including a valve in said outlet line, means for applying inlet line pressure to said valve urging it closed, means for applying outlet line pressure to said valve urging it open, and means for applying an additional biasing force against said valve urging it closed.

* * * * *